US008978945B2

(12) United States Patent
Komura

(10) Patent No.: US 8,978,945 B2
(45) Date of Patent: Mar. 17, 2015

(54) MUSICAL INSTRUMENT STRAP AND MUSICAL INSTRUMENT CONNECTOR

(76) Inventor: Yumiko Komura, Hiroshima (JP)

( * ) Notice: Subject to any disclaimer, the term of this patent is extended or adjusted under 35 U.S.C. 154(b) by 730 days.

(21) Appl. No.: 12/528,958

(22) PCT Filed: Dec. 7, 2007

(86) PCT No.: PCT/JP2007/001371

§ 371 (c)(1),
(2), (4) Date: Aug. 27, 2009

(87) PCT Pub. No.: WO2008/107939

PCT Pub. Date: Sep. 12, 2008

(65) Prior Publication Data

US 2010/0032463 A1 Feb. 11, 2010

(30) Foreign Application Priority Data

Mar. 1, 2007 (JP) ..... 2007-094419

(51) Int. Cl.
*A45F 3/14* (2006.01)
*G10G 5/00* (2006.01)

(52) U.S. Cl.
CPC ..... *G10G 5/005* (2013.01); *A45F 2003/146* (2013.01); *A45F 2003/148* (2013.01); *Y10S 224/91* (2013.01)
USPC ..... 224/258; 224/259; 224/910; 84/327

(58) Field of Classification Search
USPC ..... 224/265, 576, 578, 600, 602, 607, 617, 224/627, 628, 631, 645, 646, 254, 257–259, 224/910; 84/327, 421
See application file for complete search history.

(56) References Cited

U.S. PATENT DOCUMENTS 742,892 A * 11/1903 McGill ..... 24/547
770,761 A * 9/1904 Lemly ..... 224/649

(Continued)

FOREIGN PATENT DOCUMENTS

DE 102004056964 A1 6/2006
JP 64-17595 1/1989

(Continued)

OTHER PUBLICATIONS

Machine Translation of DE 102004056964 (A1).*

(Continued)

*Primary Examiner* — Brian D Nash
*Assistant Examiner* — Corey Skurdal
(74) *Attorney, Agent, or Firm* — DASCENZO Intellectual Property Law, P.C.

(57) ABSTRACT

A musical instrument strap 100 has a neck band 101 worn on the back side of the neck of a musical instrument player, and also has a musical instrument connector 10 that is connected to both ends of the neck band 101 extending forward respectively from the left and right sides of the neck and connects the neck band 101 to a musical instrument. The musical instrument connector 10 has a flat plate 1 that prevents a right portion of the neck band 101 that extends forward from the right side of the neck, and a left portion of the neck band 101 that extends forward from the left side of the neck, from approaching each other, thereby maintaining the distance between the right portion and the left portion; and a hook 5 capable of engaging with the musical instrument. The flat plate 1 has a hole where the right end of the neck band 101 is connected and a hole where the left end of the neck band 101 is connected, and the left and right holes are spaced from each other by a predetermined distance.

16 Claims, 14 Drawing Sheets

(56) References Cited

U.S. PATENT DOCUMENTS

| | | | | | |
|---|---|---|---|---|---|
| 2,061,464 | A | * | 11/1936 | Heimers | 84/280 |
| 2,947,456 | A | * | 8/1960 | Seron | 224/258 |
| 3,692,263 | A | * | 9/1972 | Pravaz | 244/151 A |
| 4,802,613 | A | * | 2/1989 | Tierney | 224/606 |
| 6,040,509 | A | * | 3/2000 | Fanella | 84/280 |
| 6,457,774 | B2 | * | 10/2002 | Baloga | 297/250.1 |
| 2007/0012261 | A1 | * | 1/2007 | Altieri | 119/770 |

FOREIGN PATENT DOCUMENTS

| | | |
|---|---|---|
| JP | 64-55986 | 4/1989 |
| JP | 3-94595 | 9/1991 |
| JP | 5-71896 | 9/1993 |
| JP | 3095362 | 5/2003 |
| JP | 2006-97220 | 4/2006 |
| JP | 2007-114713 | 5/2007 |
| JP | 2007-286104 | 11/2007 |
| WO | WO 00/41589 A2 | 7/2000 |

OTHER PUBLICATIONS

International Search Report, PCT/JP2007/001371, 3 pages, Japanese Patent Office, Mar. 25, 2008.
English-language abstract of JP 2007-286104.
English-language abstract of JP 2007-114713.
English-language abstract of DE 102004056964 A1.
English-language abstract of JP 2006-97220.
English-language abstract of JP 3095362.
English-language abstract of WO 2000/041589 A2.
English-language abstract of JP 5-71896.
English-language abstract of JP 3-94595.
English-language abstract of JP 64-55986.
English-language abstract of JP 64-17595.

* cited by examiner

MUSICAL INSTRUMENT STRAP AND MUSICAL INSTRUMENT CONNECTOR

TECHNICAL FIELD

The present invention relates to a musical instrument strap for attaching a musical instrument and a musical instrument connector used in that musical instrument strap, and more specifically relates to a musical instrument strap and musical instrument connector for hanging a musical instrument such as a saxophone.

BACKGROUND ART

As conventional musical instrument straps of this type, there have been various proposals. Broadly classified, there are "neck straps" that are hung from a player's neck, "shoulder straps" that are hung from one shoulder, and also "harness straps" that are hung from both shoulders.

For example, Patent Document 1 discloses a shoulder strap. This shoulder strap is configured so that a one-sided strap is fixed using an abdominal belt. With this shoulder strap, it is possible to lighten the load on the neck of a player.

Patent Document 2 discloses a harness strap. In the case of this harness strap as well, the advantage that it is possible to likewise lighten the load on the neck of a player is recognized.

Patent Document 1: JP 3095362Y

Patent Document 2: JP H5-71896U

SUMMARY OF INVENTION

Technical Problem

However, a "neck strap" has the disadvantage that because a heavy musical instrument is hung from a hanger with the strap worn on the player's neck, all of the weight of the musical instrument is concentrated on the player's neck. Accordingly, there is the problem that the player naturally slouches forward, so the player's neck hurts, and also, there is pressure on the lungs, so breathing becomes difficult. Furthermore, tension of the neck muscles is made unavoidable, and as a result, the throat is constricted, and tension is also produced in the shoulders and face muscles, which adversely affects sound quality and timbre.

With a "shoulder strap" that is hung from a shoulder, the weight of the musical instrument is supported by the shoulder, so the player is liberated from weight of the musical instrument on the neck, but there is the disadvantage that because the musical instrument is supported in a tilted state, the musical instrument is not stable, and is played in a difficult posture.

Furthermore, because there is strong pressure on the front and back of the chest, a state of complete liberation from the weight of the musical instrument is far from being achieved, so breathing is difficult, which adversely affects sound quality and timbre.

With a "harness strap", the load is distributed to both shoulders, but both shoulders, the chest, and the abdomen are bound from four directions so subtle operation is difficult, and an effect on playing is unavoidable. Also, because the chest or abdomen is sandwiched from the front and back, an effect on breathing is unavoidable, thereby adversely affecting sound quality and timbre.

Also, in the case of the shoulder strap disclosed in Patent Document 1, the abdomen is fixed in a form like a belt, so there is pressure on the abdomen, and thus stability is inadequate.

Furthermore, in the case of the harness strap disclosed in Patent Document 2 as well, the strap protrudes to the front of the body from below both armpits, so pressure on the chest is unavoidable. In addition, the strap for both shoulders is not fixed, so there is a possibility of the strap slipping down, and thus stability is inadequate.

The present invention was made in view of the foregoing points, and it is an object thereof to provide a musical strap and a musical instrument connector whereby there is little burden on the player. It is a further object to provide a musical instrument strap and a musical instrument connector that insure free musical operation while playing, so that improved sound quality and timbre can be expected.

Solution to Problem

A musical instrument strap according to a first aspect is provided with a neck band worn on the back of the neck of a musical instrument player; and a musical instrument connector that is connected to both ends of the neck band extending forward respectively from the left and right of the neck, and connects the neck band to a musical instrument;

the musical instrument connector having:

a distance maintaining member that prevents a right portion of the neck band that extends forward from the right side of the neck, and a left portion of the neck band that extends forward from the left side of the neck, from approaching each other, thereby maintaining the distance between the right portion and the left portion; and an engaging member that is capable of engaging with the musical instrument;

the distance maintaining member having a first connecting portion where a right end of the neck band is connected, and a second connecting portion where a left end of the neck band is connected, the first connecting portion and the second connecting portion being spaced from each other by a predetermined distance.

A musical instrument strap according to a second aspect is provided with a neck band worn on the back of the neck of a musical instrument player;

a musical instrument connector that is connected to both ends of the neck band extending forward respectively from the left and right of the neck, and connects the neck band to a musical instrument; and a distance maintaining member that prevents a right portion of the neck band that extends forward from the right side of the neck, and a left portion of the neck band that extends forward from the left side of the neck, from approaching each other, thereby maintaining the distance between the right portion and the left portion;

the distance maintaining member having a first catch that is fastened to a portion of the neck band that is towards the neck from the right end of the neck band, and a second catch that is fastened to a portion of the neck band that is towards the neck from the left end of the neck band, the first catch and the second catch being spaced from each other by a predetermined distance.

A musical instrument connector according to a third aspect connects a neck band worn on the back of the neck of a musical instrument player to a musical instrument, and is provided with:

a distance maintaining member that prevents a right portion of the neck band that extends forward from the right side of the neck, and a left portion of the neck band that extends forward from the left side of the neck, from approaching each other, thereby maintaining the distance between the right portion and the left portion; and an engaging member that is connected to the distance maintaining member, and is capable of engaging with the musical instrument;

the distance maintaining member having a first connecting portion where a right end of the neck band is connected, and a second connecting portion where a left end of the neck band is connected, the first connecting portion and the second connecting portion being spaced from each other by a predetermined distance.

The above objects of the present invention, as well as other objects, features, and advantages of the invention, will be made clear from the below detailed description of embodiments, with reference to the attached drawings.

Advantageous Effects of Invention

According to a musical instrument strap and musical instrument connector of the invention, the load of a musical instrument is distributed to the shoulders of the player, and without constricting the neck, the burden on the neck is lightened. Also, with the invention, there are very advantageous effects such as that because the chest is not constricted, the burden on the player is reduced, liberating the player from a difficult posture, so comfortable breathing can be achieved, and thus improved sound quality and timbre can be expected.

Also, it is possible to insure free musical operation when playing.

REFERENCE SIGNS LIST

Figure 1:
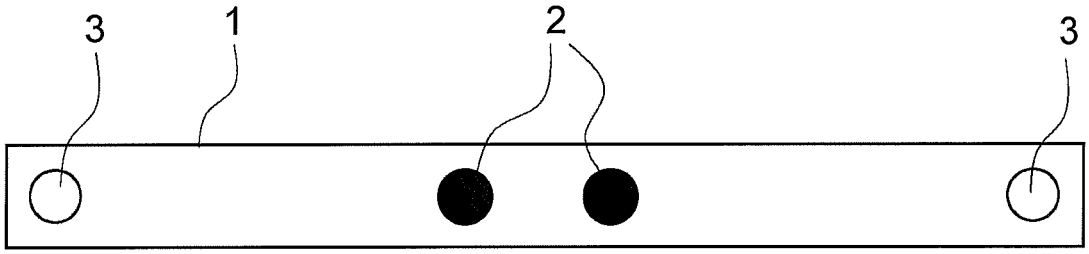
FIG. 1 is a plan view of a flat plate provided in a musical instrument connector according to Embodiment 1.

1 flat plate
3 hole
5 hook
6 support ring
10 musical instrument connector
100 musical instrument strap
101 neck band
102 supplemental band
103 right band
104 left band
200 musical instrument strap
201 neck band
210 musical instrument connector
300 musical instrument strap
301 neck band
302 supplemental band
303 right band
304 left band
310 musical instrument connector
311 distance maintaining member
311*a* ring-like portion
311*b* ring-like portion
312 length adjusting portion
313 hook
400 musical instrument strap
401 neck band
402 supplemental band
403 right band
404 left band
410 musical instrument connector
411 attachment fitting
412 length adjusting portion
413 hook
420 distance maintaining member

DESCRIPTION OF EMBODIMENTS

Following is a description of embodiments of the invention with reference to the drawings.

Embodiment 1

Figure 2:
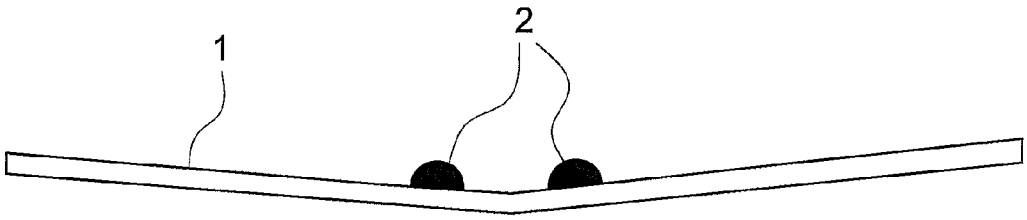
FIG. 2 is a front view of the flat plate provided in the musical instrument connector according to Embodiment 1.
Figure 3:
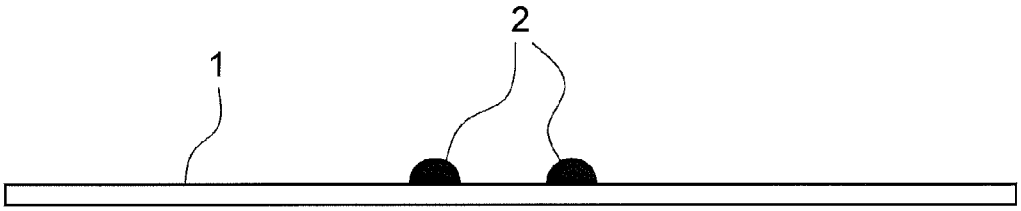
FIG. 3 is a front view of a modified example of a flat plate.

FIG. 1 is a plan view of a flat plate provided in a musical instrument connector according to Embodiment 1, and FIG. 2 is a front view of the same flat plate. A musical instrument connector 10 according to Embodiment 1 has a pair of protrusions 2 provided near the center of a flat plate 1, and connecting portions 3 that connect to a strap at both ends of the flat plate 1.

The flat plate 1 is strong enough to be capable of maintaining its shape when used connected to the strap. As long as the flat plate 1 is strong enough to have that shape, the item used for the flat plate 1 is not limited, and for example, it is possible use a metal plate, plastic, or the like for the flat plate 1.

Also, by using an item such that the weight resistance of the flat plate 1 is at least 5 kg, the burden on a player can be lightened even when playing for a long time, which is particularly preferred when using a large musical instrument.

Further, the shape of the flat plate 1 may be a flat shape, or may be slightly bent in the center as shown in FIG. 2.

The protrusions 2 are provided so that a musical instrument attachment hook 5 (see FIG. 5) used when attaching a musical instrument to the connector does not easily move from a predetermined position. The attachment position of the protrusions 2 may be selected as appropriate according to the player and the type of musical instrument, but it is beneficial that the position of the musical instrument attachment hook is fixed such that free playing is not hindered.

Figure 5:
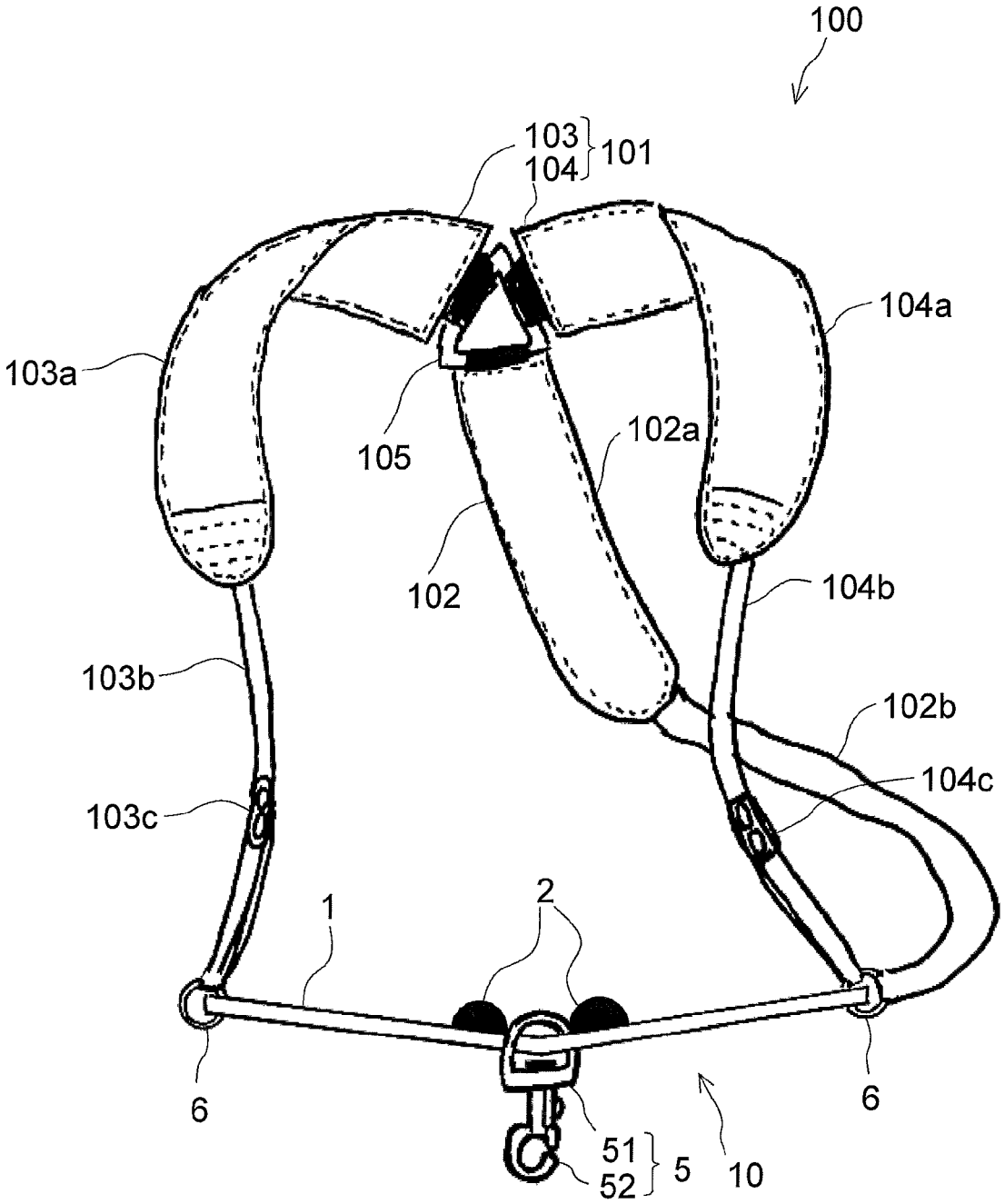
FIG. 5 is a perspective view that shows the configuration of a musical instrument strap according to Embodiment 1.

Next is a description of the configuration of a musical instrument strap according to Embodiment 1. FIG. 5 is a perspective view that shows the configuration of the musical instrument strap according to this embodiment. As shown in FIG. 5, a musical instrument strap 100 is provided with a neck band 101 that is worn on the back of the neck of the musical instrument player, and a supplemental band 102 that is worn from the back to the abdomen of the musical instrument player. The neck band 101 includes a right band 103 that is worn on the right shoulder of the musical instrument player, and a left band 104 that is worn on the left shoulder of the musical instrument player. The right band 103 is configured from an upper band 103*a* and a lower band 103*b* extending from the upper band 103*a*, and the left band 104 is configured from an upper band 104*a* and a lower band 104*b* extending from the upper band 104*a*. The two upper bands 103*a* and 104*a* are connected by a triangular ring-like fastener 105. More specifically, one end of the upper band 103*a* for the right shoulder is attached to one side of the fastener 105, and one end of the upper band 104*a* for the left shoulder is attached to another side of the fastener 105. Thus, the upper band 103*a* for the right shoulder and the upper band 104*a* for the left shoulder respectively extend to the right and left separated by an angle that corresponds to the angle between the two sides of the fastener 105. The upper band 103*a* and the upper band 104*a* are configured with a sponge covered by a flexible leather, such that the musical instrument player does not feel any pain when the upper band 103*a* and the upper band 104*a* are in contact with the neck and shoulders of the musical instrument player.

The musical instrument strap 100 is worn by the musical instrument player with the fastener 105 positioned on the back of the musical instrument player. The upper band 103*a* for the right shoulder is worn from the back of the neck forward via the right shoulder of the musical instrument player, and the upper band 104*a* for the left shoulder is worn from the back of the neck forward via the left shoulder of the musical instrument player. When being worn, the upper bands 103*a* and 104*a* each end at a position near the collarbone of the musical instrument player. The lower bands 103*b* and 104*b*, which are thinner than the upper bands 103*a* and 104*a*, respectively extend from the front end of the upper bands 103*a* and 104*b*. Only one end of the lower bands 103*b* and 104*b* is connected to the upper bands 103*a* and 104*a*, and the other end is folded back at some intermediate point and fastened to adjusting fittings 103*c* and 104*c* used for length adjustment. With the adjusting fittings 103*c* and 104*c*, it is possible to adjust the length of the fold-back of the lower bands 103*b* and 104*b*, and thus it is possible to respectively adjust the length of the lower bands 103*b* and 104*b*. Also, the end of the right lower band 103*b* that has been folded back is connected to the right end of the flat plate 1 of the musical instrument connector 10 via a support ring 6, and the end of the left lower band 104*b* that has been folded back is connected to the left end of the flat plate 1 via the support ring 6.

As described above, the upper band 103*a* for the right shoulder is attached to one side of the fastener 105, and the upper band 104*a* for the left shoulder is attached to another side of the fastener 105. One end of the supplemental band 102 is attached to the remaining side of the fastener 105. The supplemental band 102 is configured with an upper band 102*a* attached to the fastener 105 and a lower band 102*b* extending from the tip end of the upper band 102*a*. The upper band 102*a*, like the upper bands 103*a* and 104*a*, is configured with a sponge covered by a flexible leather, in order to insure cushioning. Also, the lower band 102*b* is a band with a narrower width than the upper band 102*a*, and the tip end of the lower band 102*b* is connected to the left end of the flat plate 1 of the musical instrument connector 10 via the support ring 6.

The musical instrument connector 10 is provided with the flat plate 1 that is long in one direction, and the musical instrument attachment hook 5 that is attached to the middle portion of the flat plate 1. The flat plate 1, as shown in FIG. 1, has holes 3 used to connect the neck band 101 at both ends. Also, a hemispherical protrusion 2 is provided at each of two positions slightly nearer to both ends from the center of the flat plate 1 (see FIG. 2). An attachment ring 51 of the musical instrument attachment hook 5 is installed in a portion between the two protrusions 2 of the flat plate 1. The space between the two protrusions 2 is greater than the width of the attachment ring 51, and the attachment ring 51 can freely move between the two protrusions 2. Also, due to the attachment ring 51 making contact with the protrusions 2, the protrusions 2 fulfill the role of a stopper of the attachment ring 51, and therefore the attachment ring 51 is prevented from moving past the protrusions 2. The protrusions 2 are made of rubber, and are configured so that a sound is not made when the attachment ring 51 contacts the protrusions 2. The musical instrument attachment hook 5 has a hook portion 52 that is engaged with a musical instrument (saxophone), and due to this hook portion 52 being engaged with a hanging ring provided in the saxophone, the musical instrument strap 100 can be connected to the saxophone.

Also, as shown in FIG. 2, the flat plate 1 is slightly bent in the center, and is formed in substantially a V shape so as to increase in height from the center towards both ends. Accordingly, the musical instrument attachment hook 5, when a saxophone has been attached, is stably positioned at the lowest position of the center by the weight of the saxophone. On the other hand, the musical instrument attachment hook 5 is not fixed at the center of the flat plate 1, and because the musical instrument attachment hook 5 can be moved between the two protrusions 2 as described above, when the musical instrument player wishes to move the saxophone left or right, the saxophone can be freely moved between the two protrusions 2.

Figure 6:
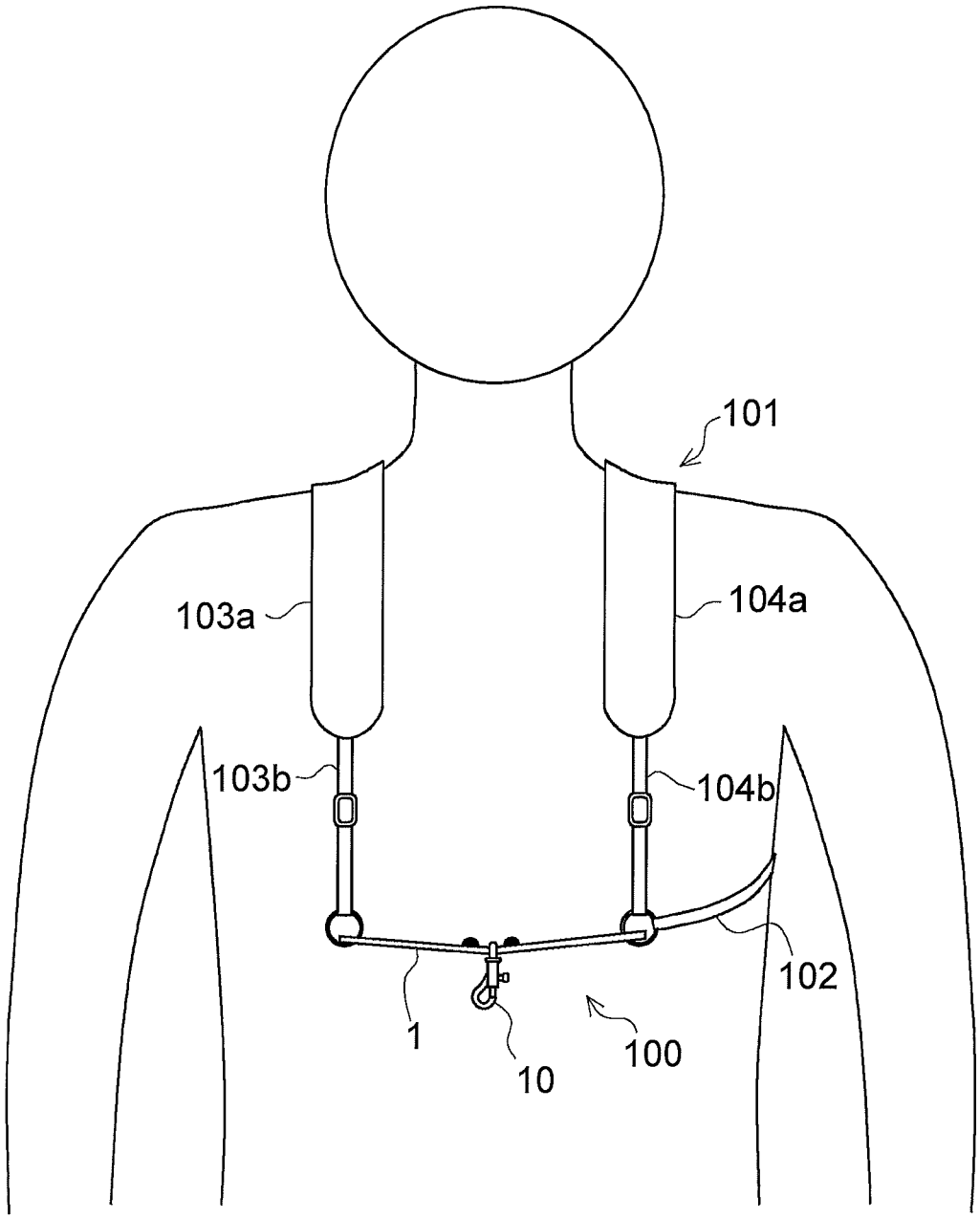
FIG. 6 is a front view that schematically illustrates a state in which the musical instrument strap according to Embodiment 1 is being worn by a musical instrument player.
Figure 7:
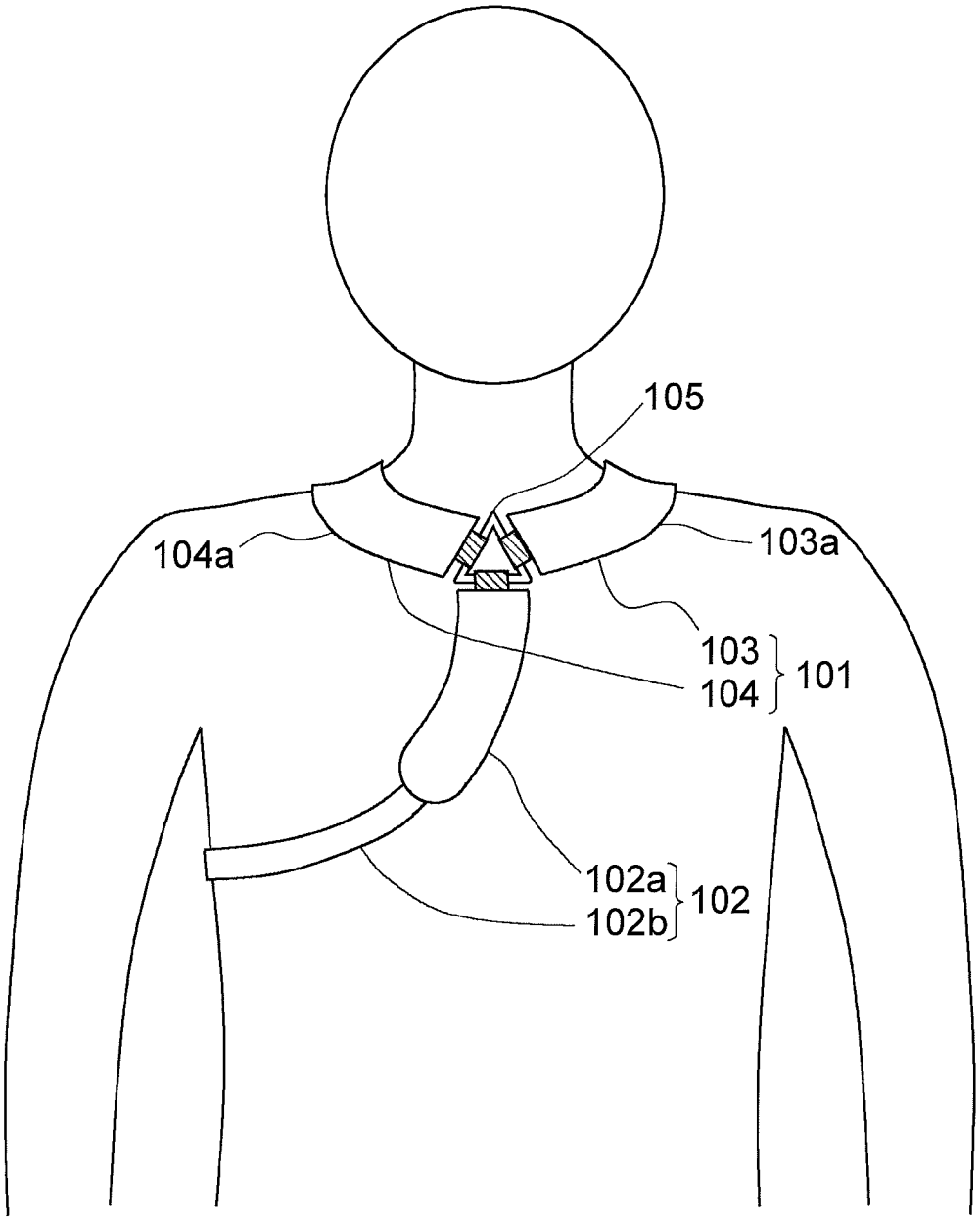
FIG. 7 is a rear view that schematically illustrates a state in which the musical instrument strap according to Embodiment 1 is being worn by a musical instrument player.

FIG. 6 is a front view that schematically illustrates a state in which the musical instrument strap according to Embodiment 1 is being worn by a musical instrument player, and FIG. 7 is a rear view of that state. When the musical instrument player uses this musical instrument strap 100, the musical instrument player wears the musical instrument strap 100 such that the fastener 105 is positioned on the player's back, the musical instrument player's neck is positioned between the upper band 103*a* for the right shoulder and the upper band 104*a* for the left shoulder, and the musical instrument connector 10 is positioned at the front of the player's body (i.e., the chest or abdomen). At this time, the upper band 103*a* for the right shoulder is positioned to the right side of the neck and the upper band 104*a* for the left shoulder is positioned to the left side of the neck. Also, the supplemental band 102 is disposed so as to pass from the back of the musical instrument player to the left side of the abdomen. The hanging ring (not shown) of the saxophone is engaged with the hook portion 52 of the musical instrument attachment hook 5.

In the case of a conventional neck strap, when initially worn, even in a state in which the neck band is on the base of the neck of the musical instrument player, both ends of the neck band connected to the musical instrument are pulled downward by the weight of the musical instrument, and thus an inward-directed force acts in the left and right portions (V-shaped portion) of the neck band positioned to the front of the musical instrument player so as to reduce the space between the left and right portions (such that the angle of the V is reduced). Also, because a member that insures the space between the left and right portions of the neck band is not present in front of the chest of the musical instrument player, due to movement of the musical instrument player, the neck band gradually moves upward to a part of the neck that is less thick than the base of the neck, resulting in a posture in which the musical instrument is actually supported by only the neck. Therefore, there is a large burden on the neck of the musical instrument player, resulting in a slouching posture and therefore pressure on the lungs, so that playing is impaired with worsened sound quality and timbre, for example. On the other hand, with the musical instrument strap 100 according to this embodiment, due to the flat plate 1 that insures a wide space between the left and right portions of the neck band 101 being provided in front of the chest of the musical instrument player, the space between the left and right portions of the neck band 101 is maintained, and so the neck band 101 is prevented from moving upward from the base of the neck. Accordingly, the burden on the player's neck is lightened.

The length of the flat plate 1 is set to 140 mm, i.e., a space of about 140 mm is maintained between the left and right portions of the neck band 101. As described above, with a neck strap, an inward-directed force acts in the left and right portions of the neck band, but with the musical instrument strap 100 according to Embodiment 1, the left and right portions of the neck band 101 are prevented from approaching each other by the flat plate 1, and a space of about 140 mm, which is the length of the flat plate 1, is maintained between the left and right portions of the neck band 101. The length of the flat plate 1 is such that when a musical instrument player having a standard physique is wearing the musical instrument strap 100, a portion of the right band 103 hanging forward from the right shoulder of the musical instrument player and a portion of the left band 104 hanging forward from the left shoulder of the musical instrument player are substantially parallel. That is, the right portion of the neck band 101 extending forward from the right side of the neck of the musical instrument player and the left portion of the neck band 101 extending forward from the left side of the neck each extend in the vertical direction. In this way, because the right portion and the left portion of the neck band 101 extend in the vertical direction, force acts in the lengthwise direction (vertical direction) in both the right portion and the left portion of the neck band 101 due to the weight of the musical instrument, and because inward-directed force is prevented, the effect of suppressing the neck band 101 from moving upward from the base of the neck is further improved.

Also, a downward force acts on the musical instrument connector 10 due to the weight of the attached saxophone, and the front end of the neck band 101 is pulled downward by this force. In addition, the supplemental band 102 connected to the musical instrument connector 10 is also pulled downward. Accordingly, by providing the supplemental band 102 as described above, the neck band 101 is pulled from the back of the musical instrument player by the supplemental band 102, so the neck band 101 is further prevented from moving upward from the base of the neck, and therefore it is possible to further lighten the burden on the neck of the musical instrument player. As a result, a slouching playing posture of the musical instrument player is prevented, and so pressure on the lungs of the musical instrument player is prevented.

Also, the musical instrument player can appropriately adjust the length of the left and right lower bands 103*b* and 104*b* to adjust the vertical position of the musical instrument. Thus, it is possible for the position of the musical instrument to be adjusted to the optimal height for the musical instrument player.

Embodiment 2

Figure 8:
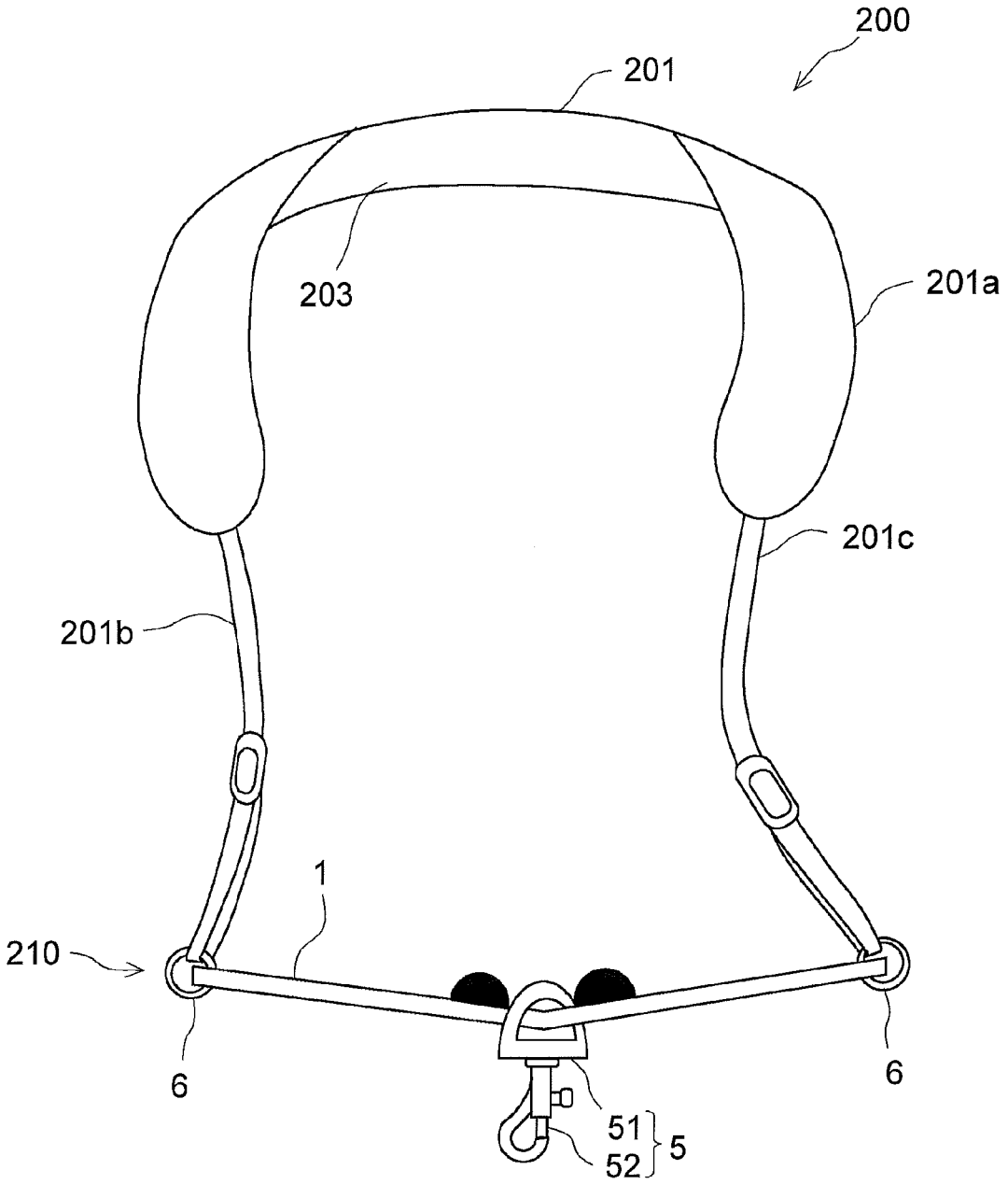
FIG. 8 is a perspective view that shows the configuration of a musical instrument strap according to Embodiment 2.

FIG. 8 is a perspective view that shows the configuration of a musical instrument strap 200 according to Embodiment 2. As shown in FIG. 8, the musical instrument strap 200 according to Embodiment 2 is provided with a neck band 201 that is worn on the back of the neck of the musical instrument player, and a musical instrument connector 210 with the same configuration as in Embodiment 1.

The neck band 201 is provided with an upper band 201*a* that is a single band, and two lower bands 201*b* and 201*c* that are connected to both ends of the upper band 201*a*. The center portion of the upper band 201*a* is disposed at the back of the neck of the musical instrument player, one end of the upper band 201*a* is worn from the back of the neck forward via the right shoulder of the musical instrument player, and the other end of the upper band 201*a* is worn from the back of the neck forward via the left shoulder. The upper band 201*a* is a band-like member with a substantially uniform width throughout its entire length, and has a three-dimensional shape in which by draping, a face (below, referred to as the back face) 203 on the side that touches the body of the musical instrument player fits closely with the back of the neck, the shoulders, and the chest of the musical instrument player. The right portion and the left portion of the upper band 201*a*, when being worn, respectively end at a position near the collarbone of the musical instrument player. Lower bands 201*b* and 201*c* that are thinner than the upper band 201*a* respectively extend from both ends of the upper band 201*a*. The configuration of the lower bands 201*b* and 201*c* is the same as the configuration of the lower bands 103*b* and 104*b* described in Embodiment 1, so that description is omitted here. The upper band 201*a* is configured with a sponge being covered by a flexible leather, such that the musical instrument player does not feel any pain when the upper band 201*a* is in contact with the neck and shoulders of the musical instrument player.

The tip end of the right lower band 201*b* is connected to the right end of the flat plate 1 provided with the musical instrument connector 210 via a support ring 6, and the tip end of the left lower band 201*c* is connected to the left end of the flat plate 1 via a support ring 6. The configuration of the musical instrument connector 210 is the same as the configuration of the musical instrument connector 10 described in Embodiment 1, so the same references are assigned to the same constituent elements, and that description is omitted here.

When the musical instrument player uses this musical instrument strap 200, the musical instrument player wears the musical instrument strap 200 such that the center of the neck band 201 is positioned on the player's back (on the back of the neck), the right side portion of the neck band 201 extends forward from the right side of the neck of the musical instrument player, the left side portion of the neck band 201 extends forward from the left side of the neck of the musical instrument player, and the musical instrument connector 210 is positioned at the front of the player's body (i.e., the chest or abdomen). The hanging ring (not shown) of the saxophone is engaged with the hook portion 52 of the musical instrument attachment hook 5.

By adopting the above sort of configuration, as in Embodiment 1, with the musical instrument strap 200 according to this embodiment, due to the flat plate 1 that is insures a wide space between the left and right portions of the neck band 201 being provided in front of the chest of the musical instrument player, the space between the left and right portions of the neck band 201 is maintained, and so the neck band 201 is prevented from moving upward from the base of the neck. Accordingly, the burden on the player's neck is lightened.

Also, the musical instrument player can appropriately adjust the length of the left and right lower bands 201*b* and 201*c* to adjust the vertical position of the musical instrument.

Thus, it is possible for the position of the musical instrument to be adjusted to the optimal height for the musical instrument player.

Embodiment 3

Figure 9:
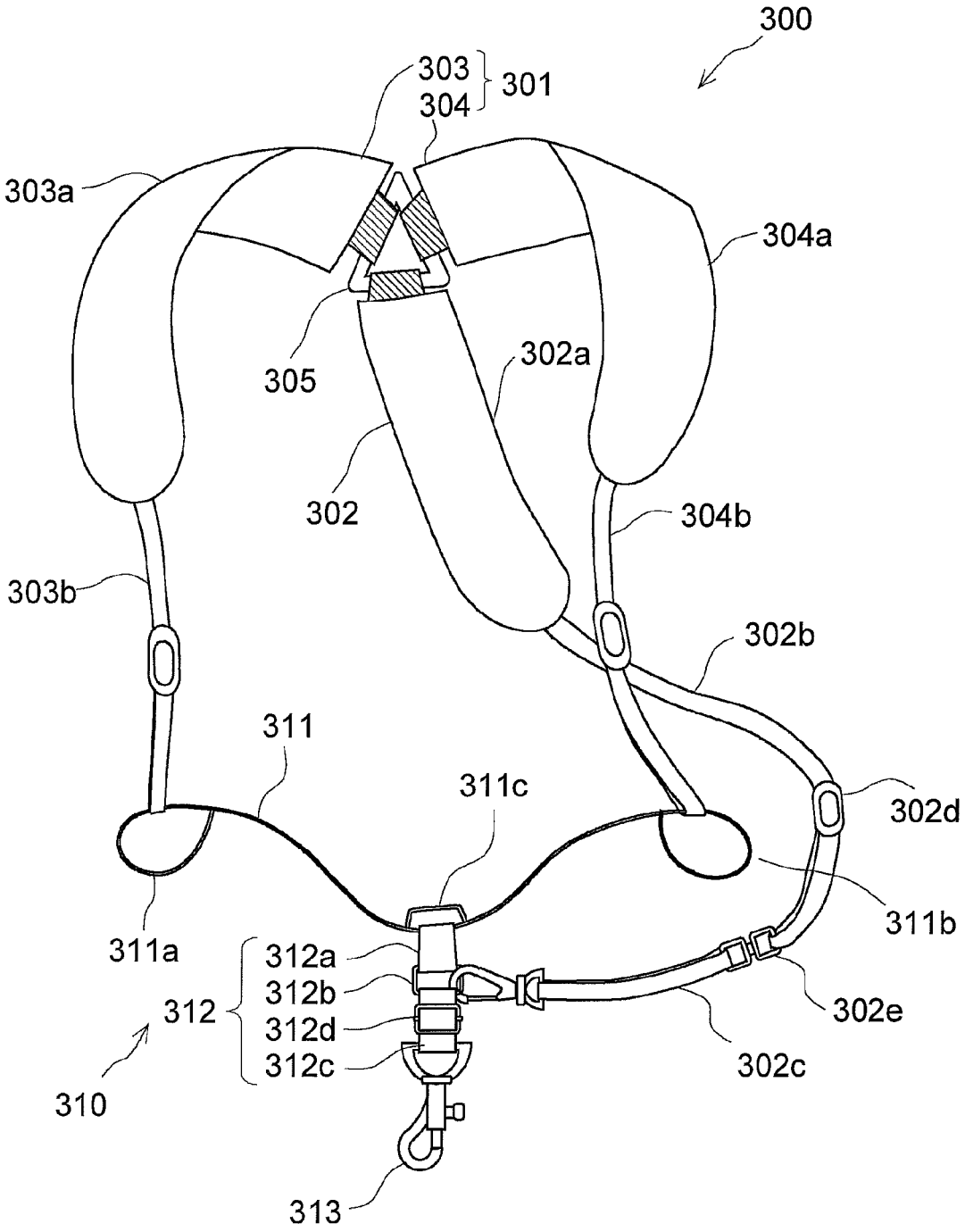
FIG. 9 is a perspective view that shows the configuration of a musical instrument strap according to Embodiment 3.

FIG. 9 is a perspective view that shows the configuration of a musical instrument strap 300 according to Embodiment 3. As shown in FIG. 9, the musical instrument strap 300 according to Embodiment 3 is provided with a neck band 301 that is worn on the back of the neck of the musical instrument player, a supplemental band 302 that is worn from the back to the abdomen of the musical instrument player, and a musical instrument connector 310 that connects the neck band 301 to a musical instrument (saxophone).

The neck band 301 is provided with a right band 303 that is worn on the right shoulder of the musical instrument player, and a left band 304 that is worn on the left shoulder of the musical instrument player. The right band 303 is configured from an upper band 303*a* and a lower band 303*b* extending from the upper band 303*a*, and the left band 304 is configured from an upper band 304*a* and a lower band 304*b* extending from the upper band 304*a*. The two upper bands 303*a* and 304*a* are connected by a triangular ring-like fastener 305. The upper bands 303*a* and 304*a*, and the fastener 305, have the same configuration as the upper bands 103*a* and 104*a* and the fastener 105 described in Embodiment 1, so that description is omitted here. Also, the manner in which the upper bands 303*a* and 304*a* and the supplemental band 302 are connected to the fastener 305 is the same as the manner in which the upper bands 103*a* and 104*a* and the supplemental band 102 are connected to the fastener 105 described in Embodiment 1, so that description is omitted here.

The lower band 303*b*, which is thinner than the upper band 303*a*, extends from the tip end of the upper band 303*a* of the right band 303. The lower band 304*b*, which is thinner than the upper band 304*a*, extends from the tip end of the upper band 304*a* of the left band 304. The configuration of the lower bands 303*b* and 304*b* is the same as the configuration of the lower bands 103*b* and 104*b* described in Embodiment 1, so that description is omitted here.

The supplemental band 302 is configured with an upper band 302*a* attached to the fastener 305, a lower band 302*b* extending from the tip end of the upper band 302*a*, and a hook portion 302*c* for connecting to the musical instrument connector 310. The configuration of the upper band 302*a* is the same as the configuration of the upper band 102*a* described in Embodiment 1, so that description is omitted here. Only one end of the lower band 302*b* is connected to the upper band 302*a*, and the other end is folded back at some intermediate point and fastened to an adjusting fitting 302*d* used for length adjustment. With the adjusting fitting 302*d*, it is possible to adjust the length of the fold-back of the lower band 302*b*, and thus it is possible to adjust the length of the lower band 302*b*. Also, a hook portion 302*c* is connected to the end of the lower band 302*b* that has been folded back via a connection fitting 302*e*.

Next is a detailed description of the musical instrument connector 310 according to Embodiment 3. As shown in FIG. 9, the musical instrument connector 310 is provided with a distance maintaining member 311 for maintaining the distance between a right portion and a left portion of the neck band 301, a length adjusting portion 312 for adjusting length, and a musical instrument attachment hook 313 connected to a saxophone. The distance maintaining member 311 is configured using a wire-like metal. Both ends of the distance maintaining member 311 are curved in a ring shape to form ring-like portions 311*a* and 311*b*. The tip of the lower band 303*b* of the right band 303 is attached to the right ring-like portion 311*a*, and the tip of the lower band 304*b* of the left band 304 is attached to the left ring-like portion 311*b*. Thus, the neck band 301 is connected to the distance maintaining member 311. Also, a ring-like adjuster attachment 311*c* is provided in the center portion of the distance maintaining member 311, and the length adjusting portion 312 is attached to the adjuster attachment 311*c*. The length adjusting portion 312 has a first band 312*a* made of cloth, an attachment fitting 312*b*, a second band 312*c* made of cloth, and an adjusting fitting 312*d* used for length adjustment. The first band 312*a* is connected to the adjuster attachment 311*c* of the distance maintaining member 311. The width of the first band 312*a* is slightly less than the width of the adjuster attachment 311*c*, and therefore the length adjusting portion 312 is substantially unable to move in the lateral direction relative to the distance maintaining portion 311, i.e., is positioned in the center of the distance maintaining portion 311.

A ring-like attachment fitting 312*b* is attached to the lower end of the first band 312*a*. A hook portion 302*c* of the supplemental band 302 described above is engaged with this attachment fitting. One end of the second band 312*c* is connected to the attachment fitting 312*b*. Only one end of the second band 312*c* is connected to the attachment fitting 312*b*, and the other end is folded back at some intermediate point and fastened to the adjusting fitting 312*d* used for length adjustment. With the adjusting fitting 312*d*, it is possible to adjust the length of the fold-back of the second band 312*c*, and thus it is possible to adjust the length of the second band 312*c*. Also, a base end portion of the musical instrument attachment hook 313 is connected to the end of the second band 312*c* that has been folded back.

When the musical instrument player uses this musical instrument strap 300, the musical instrument player wears the musical instrument strap 300 such that the fastener 305 is positioned on the player's back, the neck of the musical instrument player is positioned between the upper band 303*a* for the right shoulder and the upper band 304*a* for the left shoulder, and the musical instrument connector 310 is positioned at the front of the player's body (i.e., the chest or abdomen). At this time, the upper band 303*a* for the right shoulder is positioned on the right side of the neck and the upper band 304*a* for the left shoulder is positioned on the left side of the neck. The supplemental band 302 is disposed so as to pass from the back of the musical instrument player through the left side of the abdomen. The hanging ring (not shown) of the saxophone is engaged with the musical instrument attachment hook 313.

With the musical instrument strap 300 according to this embodiment, due to the distance maintaining member 311 that insures a wide space between the left and right portions of the neck band 301 being provided in front of the chest of the musical instrument player, the space between the left and right portions of the neck band 301 is maintained, and so the neck band 301 is prevented from moving upward from the base of the neck. Accordingly, the burden on the player's neck is lightened.

The length of the distance maintaining member 311 is set to 140 mm, so that a space of about 140 mm is maintained between the left and right front portions of the neck band 301. With the musical instrument strap 300 according to Embodiment 3, the left and right portions of the neck band 301 are prevented from approaching each other by the distance maintaining member 311, and a space of about 140 mm, which is the length of the distance maintaining member 311, is maintained between the left and right front portions of the neck band 301. The length of the distance maintaining member 311 is such that when a musical instrument player having a standard physique is wearing the musical instrument strap 300, a portion of the right band 303 hanging forward from the right shoulder of the musical instrument player and a portion of the left band 304 hanging forward from the left shoulder of the musical instrument player are substantially parallel. That is, the right portion of the neck band 301 extending forward from the right side of the neck of the musical instrument player and the left portion of the neck band 301 extending forward from the left side of the neck each extend in the vertical direction. In this way, because the right portion and the left portion of the neck band 301 extend in the vertical direction, force acts in the lengthwise direction (vertical direction) in both the right portion and the left portion of the neck band 301 due to the weight of the musical instrument, and because inward-directed force is prevented, the effect of suppressing the neck band 301 from moving upward from the base of the neck is further improved.

Also, a downward force acts on the musical instrument connector 310 due to the weight of the attached saxophone, and the front end of the neck band 301 is pulled downward by this force. In addition, the supplemental band 302 connected to the length adjusting portion 312 is also pulled downward. Accordingly, by providing the supplemental band 302 as described above, the neck band 301 is pulled from the back of the musical instrument player by the supplemental band 302, so the neck band 301 is further prevented from moving upward from the base of the neck, and therefore it is possible to further lighten the burden on the neck of the musical instrument player. As a result, a slouching playing posture of the musical instrument player is prevented, and so pressure on the lungs of the musical instrument player is prevented.

Also, the musical instrument player can appropriately adjust the length of the length adjusting portion 312 provided below the distance maintaining member 311 to adjust the vertical position of the musical instrument. Thus, it is possible for the position of the musical instrument to be adjusted to the optimal height for the musical instrument player. Furthermore, when a length adjusting portion is provided in both the left and right portions of the neck band, it is necessary to adjust the length of each length adjusting portion, but with the musical instrument strap 300 according to Embodiment 3 by comparison, it is possible to easily adjust the vertical position of the musical instrument by only adjusting the length of the one length adjusting portion 312, so convenience for the musical instrument player is improved.

Furthermore, the musical instrument player can appropriately adjust the length of the supplemental band 302 by adjusting the length of the lower band 302*b* provided in the supplemental band 302. Specifically, the fastener 305 is positioned lower when the length of the supplemental band 302 is shortened, and the fastener 305 is positioned higher when the length of the supplemental band 302 is increased, so the neck band 301 can be disposed at an optimal position (position where the weight of the musical instrument is easily supported) for the musical instrument player by appropriately adjusting the length of the supplemental band 302.

Embodiment 4

Figure 10:
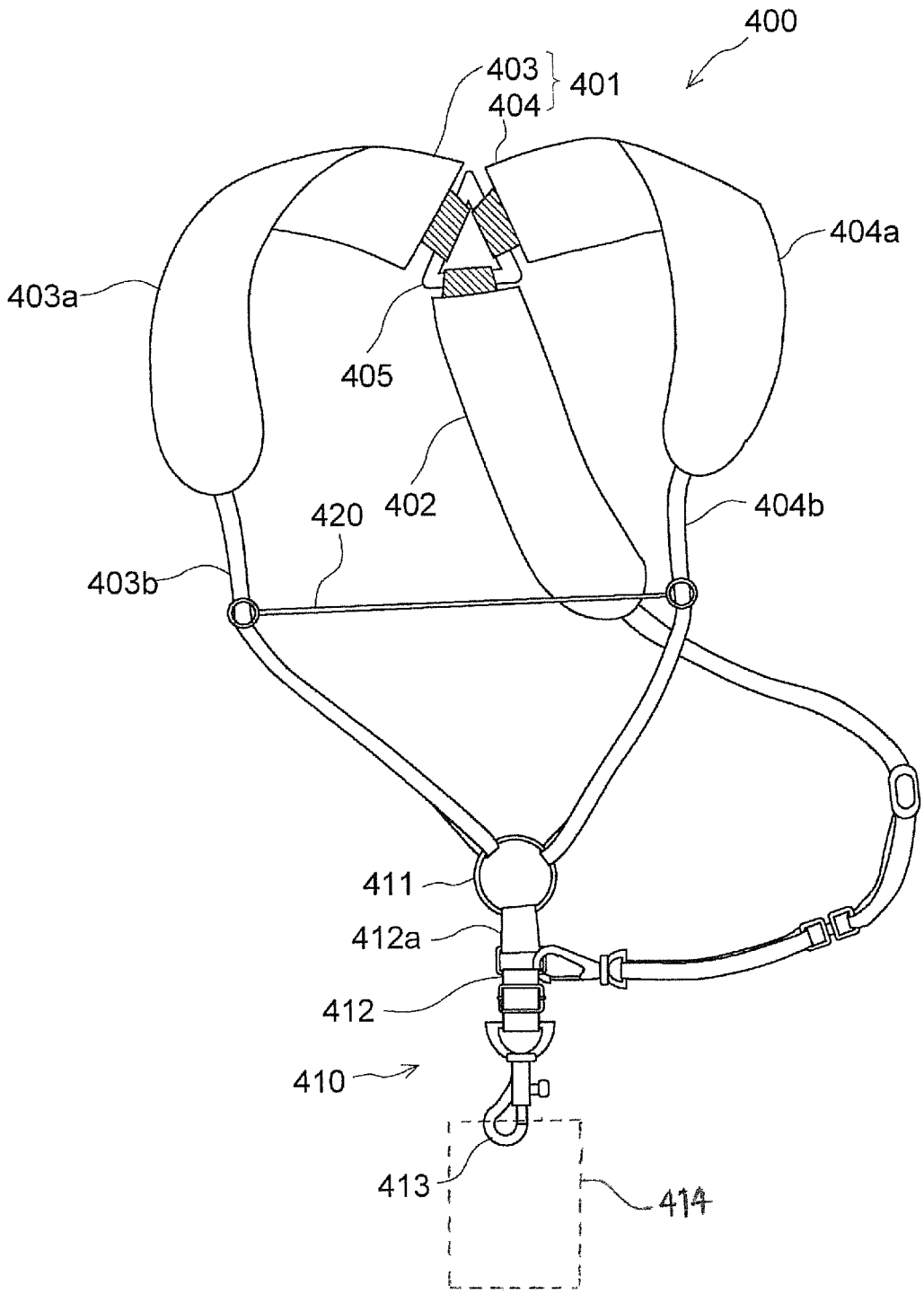
FIG. 10 is a perspective view that shows the configuration of a musical instrument strap according to Embodiment 4.

FIG. 10 is a perspective view that shows the configuration of a musical instrument strap 400 according to Embodiment 4. As shown in FIG. 10, the musical instrument strap 400 according to Embodiment 4 is provided with a neck band 401 that is worn on the back of the neck of the musical instrument player, a supplemental band 402 that is worn from the back to the abdomen of the musical instrument player, a musical instrument connector 410 that connects the neck band 401 to a musical instrument (saxophone), and a distance maintaining member 420 that maintains the distance between a right portion of the neck band 401 extending forward from the right side of the neck of the musical instrument player and a left portion of the neck band 401 extending forward from the left side of the neck.

The neck band 401 is provided with a right band 403 worn on the right shoulder of the musical instrument player and a left band 404 worn on the left shoulder of the musical instrument player. The right band 403 is configured from an upper band 403*a* and a lower band 403*b* extending from the upper band 403*a*, and the left band 404 is configured from an upper band 404*a* and a lower band 404*b* extending from the upper band 404*a*. The two upper bands 403*a* and 404*a* are connected by a triangular ring-like fastener 405. The configuration of the upper bands 403*a* and 404*a* and the fastener 405 is the same as the configuration of the upper bands 103*a* and 104*a* and the fastener 105 described in Embodiment 1, so that description is omitted here. Also, the manner in which the upper bands 403*a* and 404*a* and the supplemental band 402 are connected to the fastener 405 is the same as the manner in which the upper bands 103*a* and 104*a* and the supplemental band 102 are connected to the fastener 105 described in Embodiment 1, so that description is omitted here.

The lower band 403*b*, which is thinner than the upper band 403*a*, extends from the tip end of the upper band 403*a* of the right band 403. The lower band 404*b*, which is thinner than the upper band 404*a*, extends from the tip end of the upper band 404*a* of the left band 404. The tip ends of the lower bands 403*b* and 404*b* respectively are folded back to form a ring-like shape. The end of the right lower band 403*b* that has been folded back and the end of the left lower band 404*b* that has been folded back are each connected to the musical instrument connector 410.

As shown in FIG. 10, the musical instrument connector 410 is provided with a length adjusting portion 412 for adjusting length and a musical instrument attachment hook 413 connected to a saxophone, which is schematically indicated in FIG. 10 at 414. The tip end of the lower band 403*b* and the tip end of the lower band 404*b* of the neck band 401 are connected to a ring-like attachment fitting 411. A first band 412*a* of the length adjusting portion 412 is connected to the attachment fitting 411. The configuration of the length adjusting portion 412 and the musical instrument attachment hook 413 is the same as the configuration of the length adjusting portion 312 and the musical instrument attachment hook 313 described in Embodiment 3, so that description is omitted here. Also, the configuration of the supplemental band 402 is the same as the configuration of the supplemental band 302 described in Embodiment 3, so that configuration is omitted here.

Figure 11:
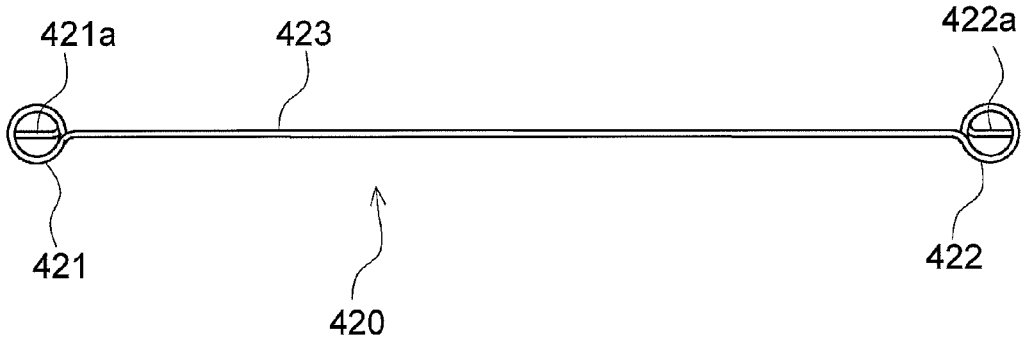
FIG. 11 is a front view that shows the configuration of a distance maintaining member according to Embodiment 4.

In the musical instrument strap 400 according to Embodiment 4, the distance maintaining member 420, which prevents the right portion of the neck band 401 extending forward from the right side of the neck of the musical instrument player and the left portion of the neck band 401 extending forward from the left side of the neck from approaching each other, thereby maintaining the space between the right portion and left portion, is provided separate from the musical instrument connector 410. FIG. 11 is a front view that shows the configuration of the distance maintaining member according to Embodiment 4. As shown in FIG. 11, the distance maintaining member 420 is configured from a long, thin wire-like metal. A catch 421 that is fastened to the right portion of the neck band 401 is provided at the right end (the left end when viewing the paper face in FIG. 11) of the distance maintaining member 420, and a catch 422 that is fastened to the left portion of the neck band 401 is provided at the left end (the right end when viewing the paper face in FIG. 11) of the distance maintaining member 420. The catches 421 and 422 are each formed in a circular ring-like shape, and have horizontally long bar-like portions 421*a* and 422*a* in the center in the vertical direction. The bar-like portions 421*a* and 422*a* have substantially the same length as the width of the lower bands 403*b* and 404*b* of the neck band 401. The lower band 403*b* is placed on the bar-like portion 421*a* of the right catch 421 and the lower band 404*b* is placed on the bar-like portion 422*a* of the left catch 422. More specifically, in the lower band 403*b* (404*b*), the portion above and the portion below (semi-circular portion) from the bar-like portion 421*a* (422*a*) of the catch 421 (422) are each disposed on the back side of the catch 421 (422), and in the center position in the vertical direction of the catch 421 (422), the lower band 403*b* (404*b*) is disposed on the front side of the bar-like portion 421*a* (422*a*). Due to the lower bands 403*b* and 404*b* being arranged on the bar-like portions 421*a* and 422*a* in this way, the distance maintaining member 420 is fastened to the lower bands 403*b* and 404*b*, so that the distance maintaining member 420 is prevented from dropping downward.

A middle portion 423 that connects the catches 421 and 422 of the distance maintaining member 420 is formed in a long, thin bar-like shape, and with the middle portion 423 the length of the distance maintaining member 420 is set to 140 mm. The distance maintaining member 420 is disposed at the position of the chest of the musical instrument player. As described above, the catches 421 and 422 are fastened to the lower bands 403*b* and 404*b*, so the distance maintaining member 420 does not drop from the position of the chest of the musical instrument player. Moreover, by configuring the catches 421 and 422 in the above manner, the musical instrument player can easily move the distance maintaining member 420 up or down, so the distance maintaining member 420 can be disposed at an appropriate position according to the physique or desires of the musical instrument player.

With the musical instrument strap 400 according to this embodiment, due to the distance maintaining member 420 that insures a wide space between the left and right portions of the neck band 401 being provided in front of the chest of the musical instrument player, the space between the left and right front portions of the neck band 401 is maintained, and so the neck band 401 is prevented from moving upward from the base of the neck. Accordingly, the burden on the player's neck is lightened.

Also, as described above, a distance of about 140 mm is maintained between the left and right front portions of the neck band 401 by the distance maintaining member 420. That is, with the musical instrument strap 400 according to Embodiment 4, the left and right front portions of the neck band 401 are prevented from approaching each other by the distance maintaining member 420, and a space of about 140 mm, which is the length of the distance maintaining member 420, is maintained between the left and right front portions of the neck band 401. The length of the distance maintaining member 420 is such that when a musical instrument player having a standard physique is wearing the musical instrument strap 400, a portion of the right band 403 hanging forward from the right shoulder of the musical instrument player and a portion of the left band 404 hanging forward from the left shoulder of the musical instrument player are substantially parallel. That is, the right portion of the neck band 401 extending forward from the right side of the neck of the musical instrument player and the left portion of the neck band 401 extending forward from the left side of the neck each extend in the vertical direction. In this way, because the right portion and the left portion of the neck band 401 extend in the vertical direction, force acts in the lengthwise direction (vertical direction) in both the right portion and the left portion of the neck band 401 due to the weight of the musical instrument, and because inward-directed force is prevented, the effect of suppressing the neck band 401 from moving upward from the base of the neck is further improved.

Also, a downward force acts on the musical instrument connector 410 due to the weight of the attached saxophone, and the front end of the neck band 401 is pulled downward by this force. In addition, the supplemental band 402 connected to the length adjusting portion 412 is also pulled downward. Accordingly, by providing the supplemental band 402, the neck band 401 is pulled from the back of the musical instrument player by the supplemental band 402, so the neck band 401 is further prevented from moving upward from the base of the neck, and therefore it is possible to further lighten the burden on the neck of the musical instrument player. As a result, a slouching playing posture of the musical instrument player is prevented, and so pressure on the lungs of the musical instrument player is prevented.

Also, the musical instrument player can appropriately adjust the length of the length adjusting portion 412 provided in the musical instrument connector 410 to adjust the vertical position of the musical instrument. Thus, it is possible for the position of the musical instrument to be adjusted to the optimal height for the musical instrument player. Furthermore, when a length adjusting portion is provided in both the left and right portions of the neck band, it is necessary to adjust the length of each length adjusting portion, but with the musical instrument strap 400 according to Embodiment 4 by comparison, it is possible to easily adjust the vertical position of the musical instrument by only adjusting the length of the one length adjusting portion 412, so convenience for the musical instrument player is improved.

Furthermore, the musical instrument player can appropriately adjust the length of the supplemental band 402 by adjusting the length of the lower band provided in the supplemental band 402. Specifically, the fastener 405 is positioned lower when the length of the supplemental band 402 is shortened, and the fastener 405 is positioned higher when the length of the supplemental band 402 is increased, so the neck band 401 can be disposed at an optimal position (position where the weight of the musical instrument is easily supported) for the musical instrument player by appropriately adjusting the length of the supplemental band 402.

Other Embodiments

As described above, in Embodiment 1 the hemispherical protrusions 2 are provided on the flat plate 1, but the shape of the protrusions 2 is not particularly limited. As long as these protrusions fulfill the role of a stopper of the attachment ring 51, they may have a shape other than a hemispherical shape, such as the shape of a cube, rectangular solid, circular cone, triangular cone, or square cone.

Also, in Embodiment 1, the protrusions 2 are made of rubber, but as long as they are members such that a sound is not made between the protrusions 2 and the musical instrument attachment hook 5, the material of the protrusions 2 is not particularly limited. These protrusions can be made of a synthetic resin, and they can also be members configured by covering the surface of a body made of metal with a synthetic resin or the like.

Figure 4:
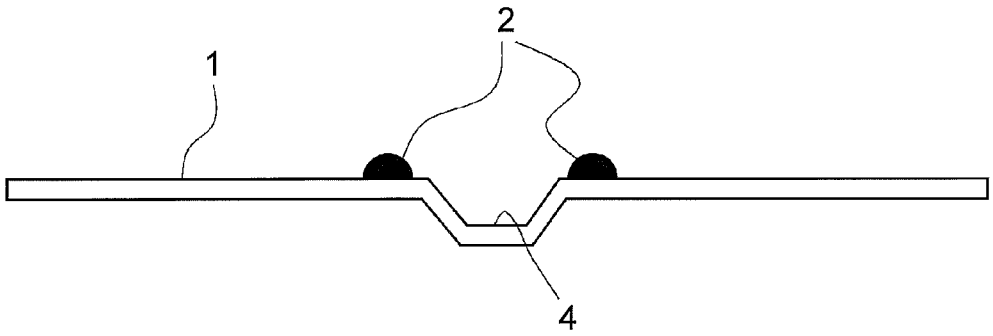
FIG. 4 is a front view of another modified example of a flat plate.

Also, in Embodiment 1, the flat plate 1 is slightly bent in the center, and is formed in substantially a V shape so as to increase in height from the center towards both ends, but this is not a limitation. As a separate mode, as shown in FIG. 4, by forming a depression 4 in the center of the flat plate 1, it is possible to use the flat plate 1 also to prevent movement of the musical attachment hook. In this case, the protrusions 2 are not required.

The shape of the depression of the flat plate 1 is not particularly limited, but may be a concave shape or a semicircular shape, for example.

As long as the strap and the musical instrument connector are connected when in use, the shape of the connecting portions 3 that connect to the strap is not particularly limited. For example, a hole may be directly formed in a connector, and the strap connected via a support ring 6 passing through the hole, or both ends of the flat plate 1 may be bent, and the strap connected via a support ring 6 passing through the bent portion.

According to the above sort of musical instrument connector, the load of the musical instrument is distributed to the shoulders of the player, so the neck is not constricted, and no burden is placed on the neck. Also, there are the very advantageous effects that because constriction of the chest is reduced, the burden on the player is reduced, liberating the player from a difficult posture, so comfortable breathing can be attained, and thus improved sound quality and timbre can be expected.

Also, it is possible to insure free musical operation when playing.

Also, in Embodiments 1 to 3, the length of the lower bands 103*b*, 104*b*, 201*b*, 201*c*, 303*b*, and 304*b* of the neck bands 101, 201, and 301 can be adjusted, but this is not a limitation; a simple band whose length cannot be adjusted may be used as a lower band. Also, in Embodiments 3 and 4, the length adjusting portions 312 and 412 are provided, but this is not a limitation; a simple band whose length cannot be adjusted may be provided instead of the length adjusting portions 312 and 412.

Also, in the musical instrument straps 100, 200, 300, and 400 according to above Embodiments 1 to 4, the flat plate 1, and the distance maintaining members 311 and 420, have a length such that the left and right front portions of the neck bands 101, 201, 301, and 401 are respectively parallel, but this is not a limitation; the distance between the left and right front portions of the neck bands 101, 201, 301, and 401 may increase at lower positions. Even if the left and right front portions of the neck band, i.e., the right portion of the neck band 401 extending forward from the right side of the neck of the musical instrument player and the left portion of the neck band 401 extending forward from the left side of the neck, are not parallel, as long as the distance between those left and right front portions does not decrease at lower positions, inward-directed force due to the weight of the musical instrument is prevented from occurring in the right and left portions, and so upward movement of the neck band 101 from the base of the neck is suppressed.

Also, in above Embodiments 3 and 4, the supplemental bands 302 and 402 are provided, but this is not a limitation; the supplemental bands 302 and 402 are not required. Also, in Embodiments 3 and 4, the hook portion 302*c* of the supplemental bands 302 and 402 is engaged with the attachment fitting 312*b* of the length adjusting portions 312 and 412 of the musical instrument connectors 310 and 410, but this is not a limitation; the tip end of the supplemental bands 302 and 402 may be connected to another portion of the length adjusting portions 312 and 412, or may be directly connected to the musical instrument. Also, in the case of Embodiment 3, the tip end of the supplemental band 302 may be connected to the left end of the distance maintaining member 311.

Also, in above Embodiments 1 to 4, the upper bands 103*a*, 104*a*, 102*a*, 201*a*, 303*a*, 304*a*, 302*a*, 403*a*, and 404*a* are configured with a sponge covered by leather, but this is not a limitation; the sponge may be covered by another flexible material such as synthetic leather, vinyl, or cloth, and an upper band may be constituted from only a flexible material, without including a sponge.

Also, in above embodiments 1 to 4, the length of the flat plate 1 and the distance maintaining members 311 and 420 is set to 140 mm, but this is not a limitation. However, in order to make the right portion of the neck band extending forward from the right side of the neck of the musical instrument player and the left portion of the neck band extending forward from the left side of the neck substantially parallel, it is preferable to set the length of the flat plate 1 and the distance maintaining members 311 and 420 to 130 to 150 mm.

Figure 12:
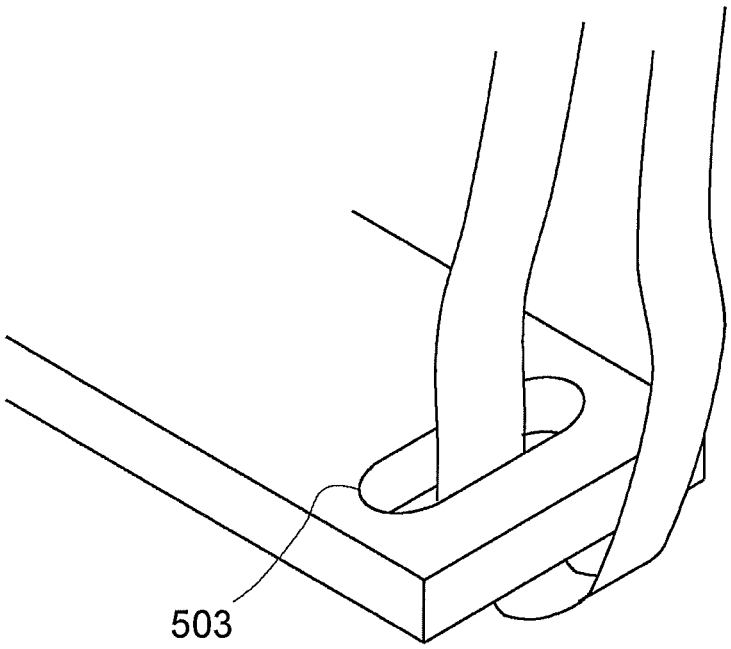
FIG. 12 is a perspective view that shows one end of a flat plate in another configuration example.

Also, in Embodiments 1 and 2, a support ring 6 is attached at both ends of the flat plate 1, and the lower bands 103*b*, 104*b*, 201*b*, and 201*c* of the neck bands 101 and 201 are connected to those support rings 6. In this configuration, the support rings 6 are stable at a position such that the center axis of the support rings 6 extends in the front-rear direction, and therefore, the lower bands 103*b*, 104*b*, 201*b*, and 201*c* are positioned such that the flat face of those lower bands follows the body surface of the chest of the player. Rather than such a configuration, a configuration can also be adopted such that the flat face of the lower bands 103*b*, 104*b*, 201*b*, and 201*c* is tilted relative to the body surface of the chest of the player. For example, as shown in FIG. 12, a configuration is adopted in which an elongated hole 503 extending in the front-rear direction is provided slightly to the inside of both ends of a flat plate, and the lower bands 103*b*, 104*b*, 201*b*, and 201*c* are passed through that elongated hole 503. By adopting such a configuration, the lower bands 103*b*, 104*b*, 201*b*, and 201*c* are oriented by the elongated hole so that their width direction is in the front-rear direction, and the portion of the neck bands 101 and 102 including the lower bands 103*b*, 104*b*, 201*b*, and 201*c* that is to the front of the neck of the player is tilted relative to the body surface of the chest of the player. By adopting such a configuration, it is possible to reduce pressure on the chest of the player by the neck bands 101 and 201.

Figure 13:
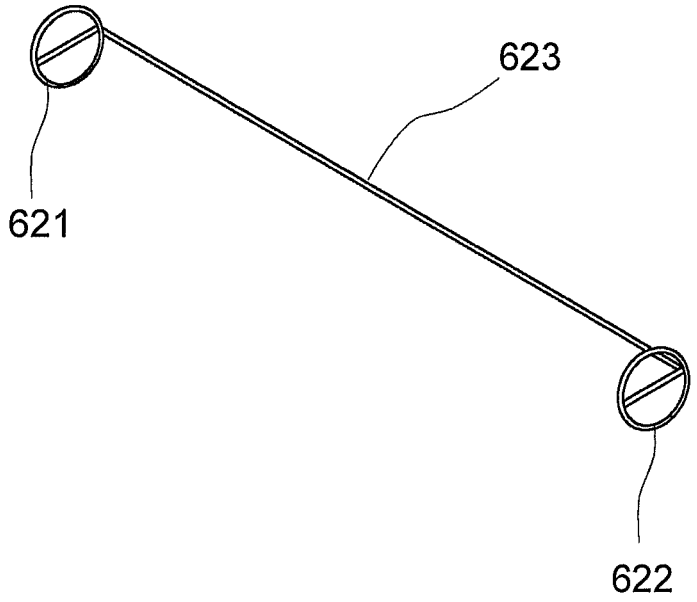
FIG. 13 is a perspective view that shows another configuration example of a distance maintaining member.

Also, in Embodiment 4, the catches 421 and 422 are provided at the left and right ends of the distance maintaining member 420, and each of the catches 421 and 422 is disposed such that their respective center axis directions are in the front-rear direction, but this is not a limitation. FIG. 13 is a perspective view that shows an example of another configuration of a distance maintaining member. As shown in FIG. 13, a distance maintaining member 620 in this example is configured with left and right catches 621 and 622 bent forward relative to a middle portion 623. By adopting such a configuration, same as in the configuration shown in FIG. 12, the flat face of the lower bands 403*b* and 404*b* is tilted relative to the body surface of the chest of the player, so it is possible to reduce the pressure on the chest of the player by the neck band 401. The bend angle of the catches 621 and 622 relative to the middle portion 623 may be 90 degrees, or may be an angle other than 90 degrees. Also, the distance maintaining member 311 according to Embodiment 3 may be configured with the ring-like portions 311*a* and 311*b* at the left and right end each bent forward, and in this case as well, it is possible to reduce the pressure on the chest of the player by the neck band 301.

Figure 14:
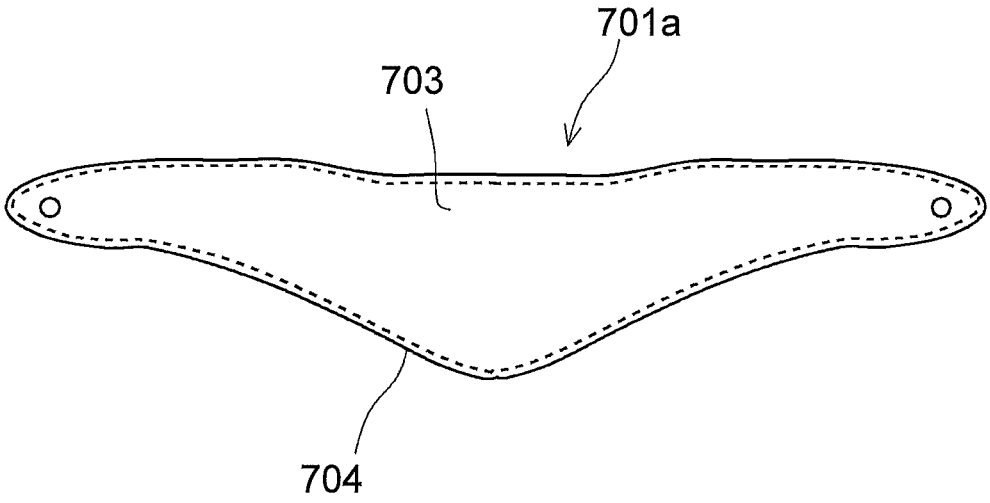
FIG. 14 is a plan view that shows another configuration example of an upper band of a neck band.

Also, in Embodiment 2, the upper band 201*a* of the neck band 201 is a band-like member with a uniform width throughout its entire length, and the back face 203 has a three-dimensional shape that fits closely with the back of the neck, the shoulders, and the chest of the musical instrument player, but this is not a limitation. FIG. 14 is an unfolded plan view of the upper band with another example configuration. An upper band 701*a* shown in FIG. 14 does not have a uniform width, rather, the upper and lower edges of the upper band 701*a* are formed in a curved shape such that the width of the upper band 701*a* decreases from the center portion to the left and right sides. Due to the upper and lower edges being curved in this way, when the musical instrument player is wearing the upper band 701*a* from the back of the neck to the chest, pressure is applied on the shoulders of the musical instrument player. Also, the upper band 701*a* has a flattened single-layer band shape when unfolded in a plane. Accordingly, when the upper band 701*a* is worn on the back of the neck of the musical instrument player, the upper band 701*a* curves following the shape of the neck. Thus, a back face 703 only fits closely with the body of the musical instrument player on the back of the neck, and the back face 703 is tilted relative to the body surface in the portion to the front of the neck of the musical instrument player, so that a bottom edge 704 of the upper band 701*a* touches the shoulders and chest. Thus, same as the configurations provided with a flat plate or a distance maintaining member shown in FIGS. 12 and 13, it is possible to lighten the pressure on the chest of the musical instrument player. Also, other than the above sort of configuration, it is also possible to adopt a configuration in which the upper band is a flattened single-layer band when unfolded in a plane, and the upper and lower edges of the upper band are straight, so that the width is uniform throughout the entire length of the upper band.

Also, in the musical instrument strap 400 according to Embodiment 4, the catches 421 and 422 provided at both ends of the distance maintaining member 420 are each formed in a round ring-like shape, and the horizontally long bar-like portions 421*a* and 422*a* are provided in the center in the vertical direction of the catches 421 and 422, but this is not a limitation; a catch may be formed in a square ring-like shape, a triangular ring-like shape, or the like, with a bar-like portion provided in the center in the vertical direction of the catch. Also, in Embodiment 4, the horizontally long bar-like portions 421*a* and 422*a* are provided in the catches 421 and 422, and the distance maintaining member 420 is fastened to the lower bands 403*b* and 404*b* by the bar-like portions 421*a* and 422*a*, but this is not a limitation; configurations such as those described below may also be adopted.

(1) A circular ring-like catch that does not include a bar-like portion is provided at both ends of a distance maintaining member, a tape having a width greater than the diameter of the catch is used as a lower band of the neck band 401, and the lower band is passed through the catch. The lower band having a width greater than the diameter of the catch is squeezed at the position of the catch. Thus, frictional force occurs between the lower band and the catch, so that the distance maintaining member is fastened by the lower band.

(2) The diameter of the catch in (1) is further reduced, and rather than a tape, a rope having approximately the same diameter as the catch is used as the lower band.

(3) A plurality of holes are provided in the lengthwise direction in the lower band, and by passing both ends of a connector through the holes, the distance maintaining member is fastened to the lower band.

From the above description, many improvements or other embodiments of the present invention will be clear to a person having ordinary skill in the art. Accordingly, the above description is to be understood as only an example, and is provided for the purpose of teaching a person having ordinary skill in the art a preferred embodiment for executing the present invention. Details of the structure and/or function of the present invention can be substantially changed without departing from the spirit of the invention.

INDUSTRIAL APPLICABILITY

The musical instrument strap and musical instrument connector according to the present invention exhibit an effect in which the weight of a musical instrument is distributed to the shoulders of a player, so the player's neck is not constricted, and the burden on the neck is lightened, and therefore the musical instrument strap and musical instrument connector according to the present invention are useful as a musical instrument strap and a musical instrument connector for a saxophone or the like.

The invention claimed is:

1. A musical instrument assembly, comprising:

a musical instrument; and a musical instrument strap connected to the musical instrument, comprising:

a neck band worn on the back of the neck of a musical instrument player;

a musical instrument connector that is connected to both ends of the neck band extending forward respectively from the left and right of the neck in a V-shape, and connects the neck band to the musical instrument; and a distance maintaining member that prevents a right portion of the neck band that extends forward from the right side of the neck, and a left portion of the neck band that extends forward from the left side of the neck, from approaching each other, thereby maintaining a wide space between the right portion and the left portion and defining the V-shape below the distance maintaining member;

the distance maintaining member forming a bar, and one end of the distance maintaining member having a first catch that is fastened to a portion of the neck band that is towards the neck from the right end of the neck band so as to be capable of sliding movement in the vertical direction, and the other end of the distance maintaining member having a second catch that is fastened to a portion of the neck band that is towards the neck from the left end of the neck band so as to be capable of sliding movement in the vertical direction, and the distance maintaining member is connected to the musical instrument connector via the neck band independent from the musical instrument connector so as to be capable of sliding movement in the vertical direction independent from the musical instrument connector, and by the first catch moving in the vertical direction along the right portion of the neck band, and the second catch moving in the vertical direction along the left portion of the neck band, the position of the distance maintaining member in the vertical direction can be adjusted, wherein the distance maintaining member does not include a structure between the first catch and the second catch through which the neck band may extend, and wherein the distance maintaining member further does not include a buckle that selectively interconnects the two ends of the distance maintaining member; wherein the distance maintaining member maintains the right portion and the left portion of the neck band in generally vertical orientations from the musical instrument player's respective right and left shoulders to the distance maintaining member.

2. The musical instrument assembly according to claim 1, wherein the distance maintaining member comprises a wire-like metal.

3. The musical instrument assembly according to claim 1, wherein the neck band includes at least one strap that extends substantially horizontally behind the neck of the musical instrument player.

4. The musical instrument assembly according to claim 1, wherein the neck band includes a right band worn on the right shoulder of the musical instrument player, a left band worn on the left shoulder of the musical instrument player, and a fastener interconnecting the right band and the left band behind the neck of the musical instrument player.

5. The musical instrument assembly according to claim 4, wherein the neck band further includes a supplemental band connected to the fastener and that is worn from the back of the musical instrument player to the abdomen of the musical instrument player.

6. The musical instrument assembly according to claim 5, wherein the fastener is a triangular ring-like fastener.

7. The musical instrument assembly of claim 4, wherein the right band includes a right upper band and a right lower band that is thinner than the right upper band, wherein the left band includes a left upper band and a left lower band that is thinner than the left upper band, and wherein the right lower band and the left lower band are connected to the musical instrument connector.

8. The musical instrument assembly of claim 7, wherein the first catch and the second catch are each formed in a circular ring-like shape with a horizontally long bar-like portion in the center of the circular ring-like shape, wherein the bar-like portion of the first catch has substantially the same length as the width of the right and left lower bands.

9. A musical instrument strap, comprising:

a neck band worn on the back of the neck of a musical instrument player;

a musical instrument connector that is connected to both ends of the neck band extending forward respectively from the left and right of the neck, and connects the neck band to a musical instrument; and a distance maintaining member that prevents a right portion of the neck band that extends forward from the right side of the neck, and a left portion of the neck band that extends forward from the left side of the neck, from approaching each other, thereby maintaining a wide space between the right portion and the left portion and defining a V-shape of the neck band below the distance maintaining member;

the distance maintaining member forming a bar, and one end of the distance maintaining member having a first catch that is fastened to a portion of the neck band that is towards the neck from the right end of the neck band so as to be capable of sliding movement in the vertical direction, and the other end of the distance maintaining member having a second catch that is fastened to a portion of the neck band that is towards the neck from the left end of the neck band so as to be capable of sliding movement in the vertical direction, and the distance maintaining member is configured to be connected to the musical instrument connector via the neck band independent from the musical instrument connector so as to be capable of sliding movement in the vertical direction independent from the musical instrument connector, and by the first catch moving in the vertical direction along the right portion of the neck band, and the second catch moving in the vertical direction along the left portion of the neck band, the position of the distance maintaining member in the vertical direction can be adjusted, wherein the distance maintaining member does not include a structure between the first catch and the second catch through which the neck band may extend, and further wherein the distance maintaining member does not include a buckle that selectively interconnects the two ends of the distance maintaining member; wherein above the distance maintaining member, the right portion and the left portion of the neck band are maintained spaced apart by a distance that is greater than a width of the musical instrument connector.

10. The musical instrument strap of claim 9, wherein the distance maintaining member comprises a wire-like metal.

11. The musical instrument strap of claim 9, wherein the neck band includes at least one strap that extends substantially horizontally behind the neck of the musical instrument player.

12. The musical instrument strap of claim 9, wherein the neck band includes a right band worn on the right shoulder of the musical instrument player, a left band worn on the left shoulder of the musical instrument player, and a fastener interconnecting the right band and the left band behind the neck of the musical instrument player.

13. The musical instrument strap of claim 12, wherein the neck band further includes a supplemental band connected to the fastener and that is worn from the back of the musical instrument player to the abdomen of the musical instrument player.

14. The musical instrument strap of claim 13, wherein the fastener is a triangular ring-like fastener.

15. The musical instrument strap of claim 12, wherein the right band includes a right upper band and a right lower band that is thinner than the right upper band, wherein the left band includes a left upper band and a left lower band that is thinner than the left upper band, and wherein the right lower band and the left lower band are connected to the musical instrument connector.

16. The musical instrument strap of claim 15, wherein the first catch and the second catch are each formed in a circular ring-like shape with a horizontally long bar-like portion in the center of the circular ring-like shape, wherein the bar-like portion of the first catch has substantially the same length as the width of the right and left lower bands.

* * * * *